US008696382B2

(12) United States Patent
Patel et al.

(10) Patent No.: US 8,696,382 B2
(45) Date of Patent: Apr. 15, 2014

(54) HIGH CURRENT ELECTRICAL CONNECTOR

(75) Inventors: Arvind Patel, Naperville, IL (US); Mark M. Data, Bolingbrook, IL (US); Jeng-De Lin, Yorkville, IL (US)

(73) Assignee: Molex Incorporated, Lisle, IL (US)

( * ) Notice: Subject to any disclaimer, the term of this patent is extended or adjusted under 35 U.S.C. 154(b) by 92 days.

(21) Appl. No.: 13/353,459

(22) Filed: Jan. 19, 2012

(65) Prior Publication Data

US 2012/0184137 A1 Jul. 19, 2012

Related U.S. Application Data

(60) Provisional application No. 61/434,183, filed on Jan. 19, 2011.

(51) Int. Cl.
*H01R 13/648* (2006.01)

(52) U.S. Cl.
USPC ..... 439/607.1; 439/862

(58) Field of Classification Search
USPC ..... 439/862, 607.01, 607.13, 607.07
See application file for complete search history.

(56) References Cited

U.S. PATENT DOCUMENTS 5,017,156 A 5/1991 Sugiyama
5,538,435 A 7/1996 Yohn
5,782,646 A * 7/1998 Broadfield et al. ..... 439/607.01
5,812,660 A * 9/1998 Suzuki et al. ..... 439/607.01
5,905,238 A 5/1999 Hung
6,068,519 A 5/2000 Lok
6,077,130 A 6/2000 Hughes et al.
6,116,956 A 9/2000 Wu
6,302,727 B1 10/2001 Fedorjaka
6,551,143 B2 4/2003 Tanaka et al.
6,663,444 B2 12/2003 Yeh
6,851,986 B2 2/2005 Zhao
6,875,049 B2 4/2005 Kyowski et al.
7,367,846 B1 5/2008 Yang
7,611,391 B2 11/2009 Long et al.
7,708,608 B2 * 5/2010 Soh ..... 439/862
2003/0190837 A1 * 10/2003 Wu ..... 439/500
2011/0287640 A1 * 11/2011 Yang et al. ..... 439/83
2013/0130557 A1 * 5/2013 Adachi et al. ..... 439/626

* cited by examiner

*Primary Examiner* — Briggitte R Hammond
(74) *Attorney, Agent, or Firm* — Stephen L. Sheldon

(57) ABSTRACT

An electrical connector includes an insulative housing, conductive terminals mounted therein, and a conductive shield generally covering the housing. A shelf of the housing supports a portion of the shield. Each terminal has a main body, a front contact portion extending from an end of the main body and capable of engagement with contacts of a battery, a rear contact portion extending from an end of the main body and capable of engagement with contacts of an electronic device, and a tail portion extending perpendicularly from the main body. The tail portion is positioned between the front and rear contact portions. The front contact portion is capable of deflecting along a plane defined by a centerline of the main body.

18 Claims, 17 Drawing Sheets

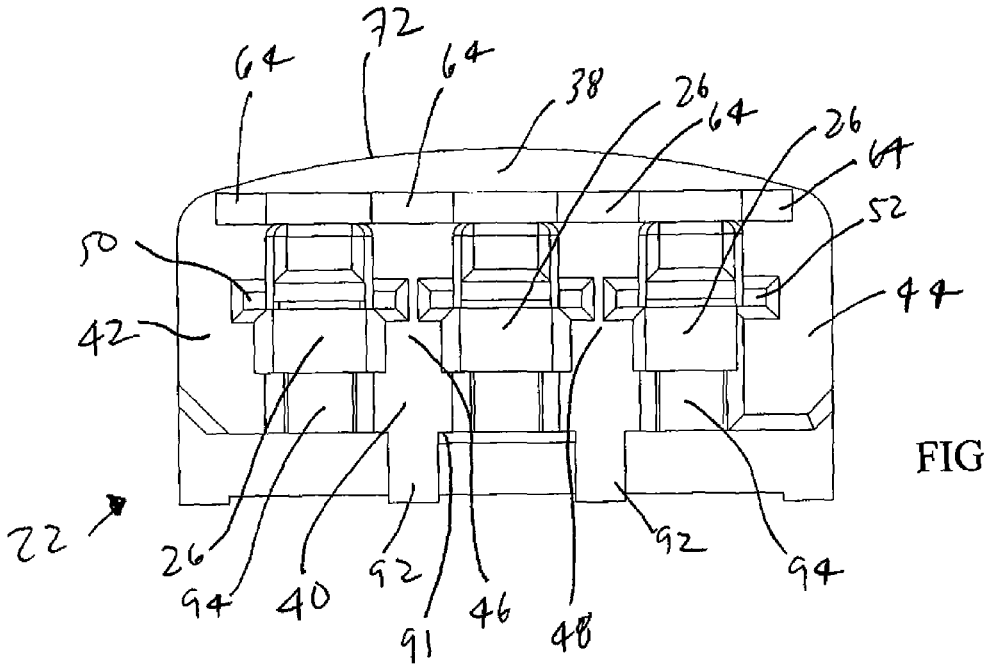
FIG. 7
FIG. 9
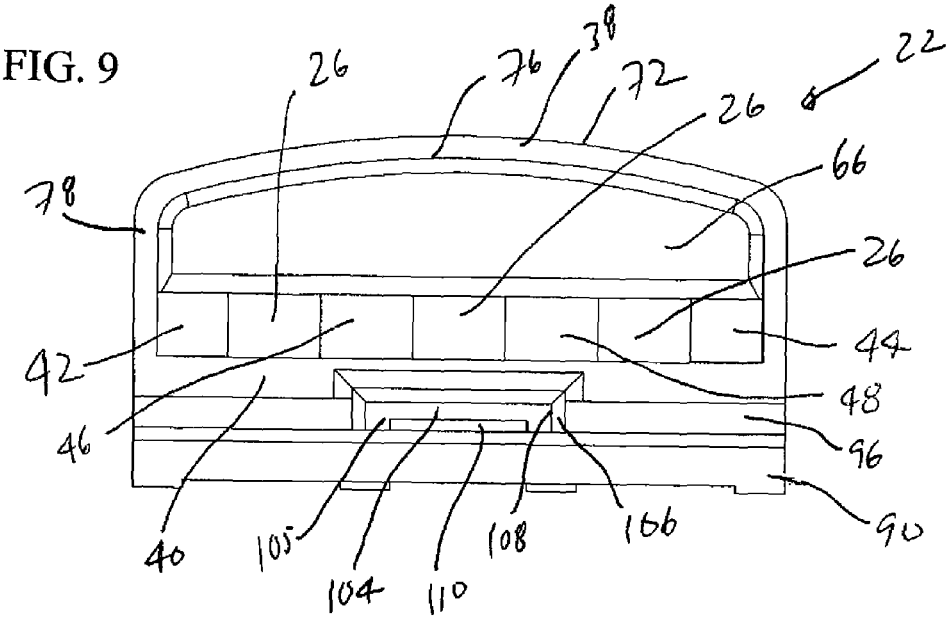

HIGH CURRENT ELECTRICAL CONNECTOR

RELATED APPLICATIONS

This application claims priority to U.S. Provisional Application No. 61/434,183, filed Jan. 19, 2011, which is incorporated herein by reference in its entirety.

FIELD OF THE INVENTION

The present invention relates to an electrical connector suitable for use in charging a battery.

BACKGROUND

Numerous electrical connectors have been proposed for connecting a battery to a printed circuit board and to an electronic device. An example of such an electrical connector is shown in U.S. Pat. No. 6,851,986. While existing electrical connectors have proven satisfactory for certain applications, they tend to be less desirable for high current applications. This is not been a problem as most batteries are unable to be charged via a high current. As technology improves, has become more feasible to charge batteries with a higher current (thus greatly reducing the recharge time). Consequentially, further improvements in electrical connector suitable for use with high current would be appreciated by certain individuals.

SUMMARY

An electrical connector includes an insulative housing, conductive terminal mounted therein, and a conductive shield generally covering the housing. A shelf of the housing supports a portion of the shield. Each terminal has a main body, a front contact portion extending from an end of the main body and capable of engagement with contacts of a battery, a rear contact portion extending from an end of the main body and capable of engagement with contacts of an electronic device, and a tail portion extending perpendicularly from the main body. The tail portion is positioned between the front and rear contact portions. The front contact portion is capable of deflecting along a plane defined by a centerline of the main body.

BRIEF DESCRIPTION OF THE DRAWINGS

The organization and manner of the depicted embodiments may best be understood by reference to the following description, taken in connection with the accompanying drawings, wherein like reference numerals identify like elements in which:

FIG. 7 is a front plan view of the housing;

FIG. 9 is a rear plan view of the housing;

DETAILED DESCRIPTION

Figure 1:
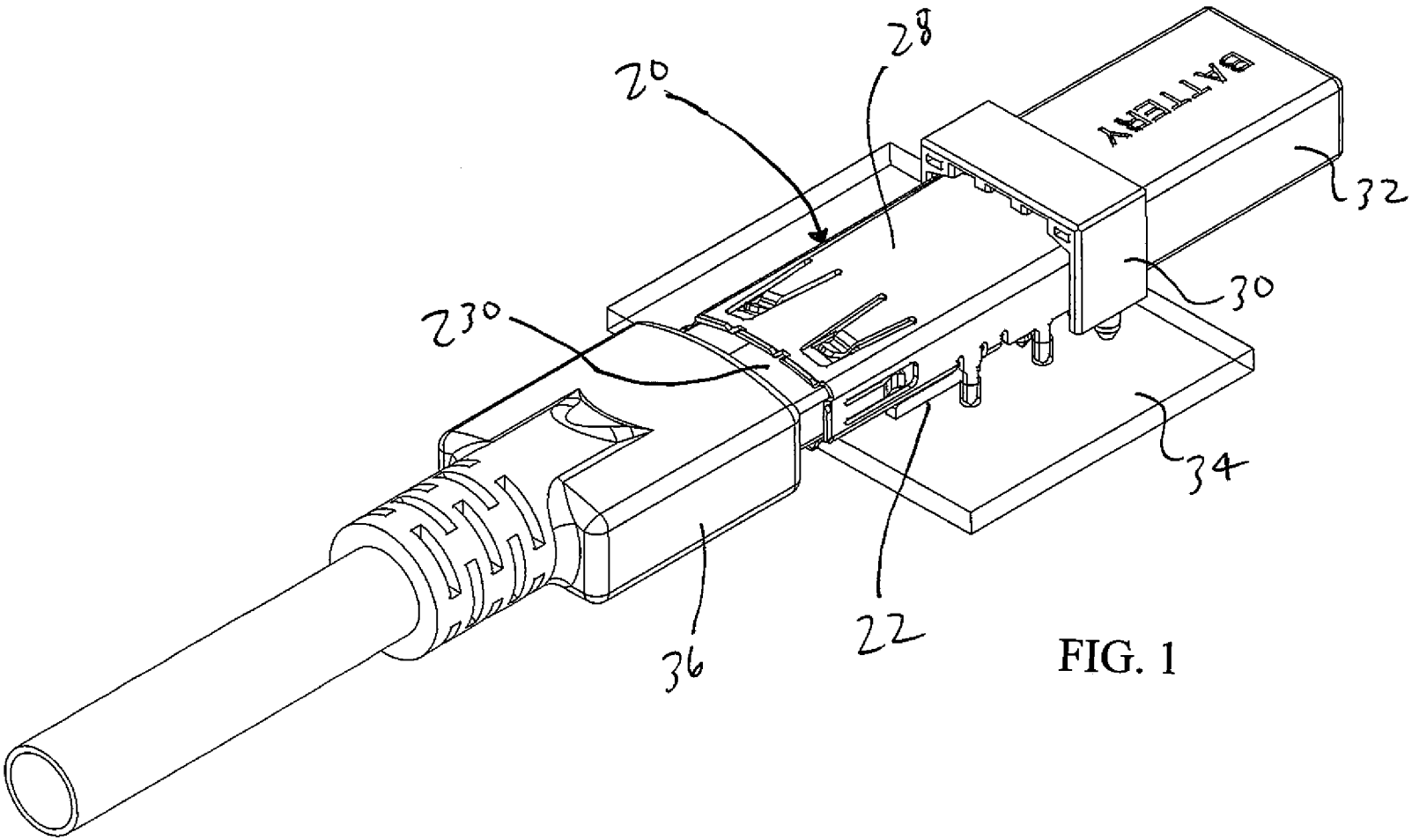
FIG. 1 is a top perspective view of an embodiment of an electrical connector connected to a battery, to printed circuit board and to a cable of an electronic device.
Figure 2:
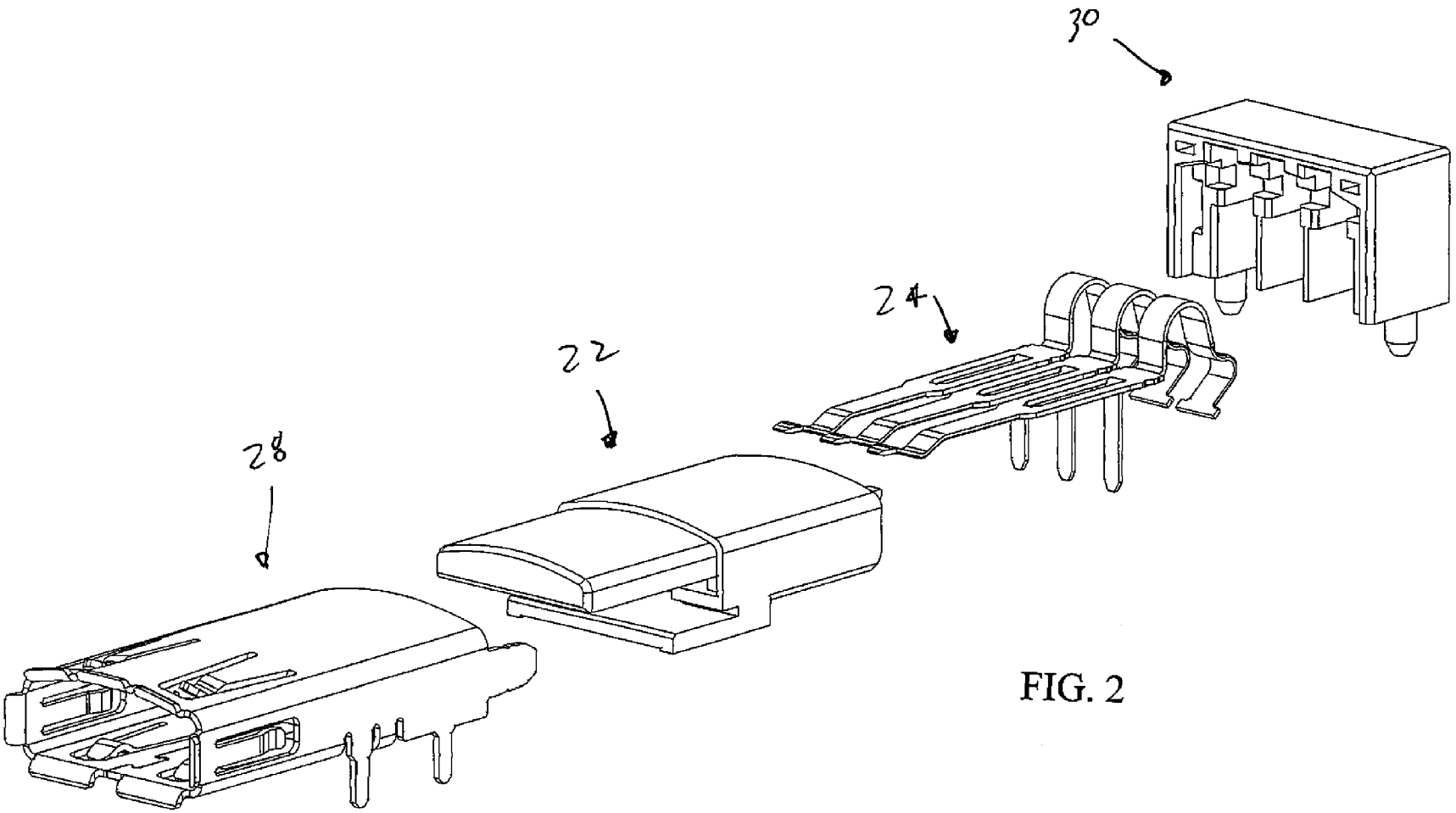
FIG. 2 is an exploded top perspective view of the components of the electrical connector of FIG. 1.
Figure 3:
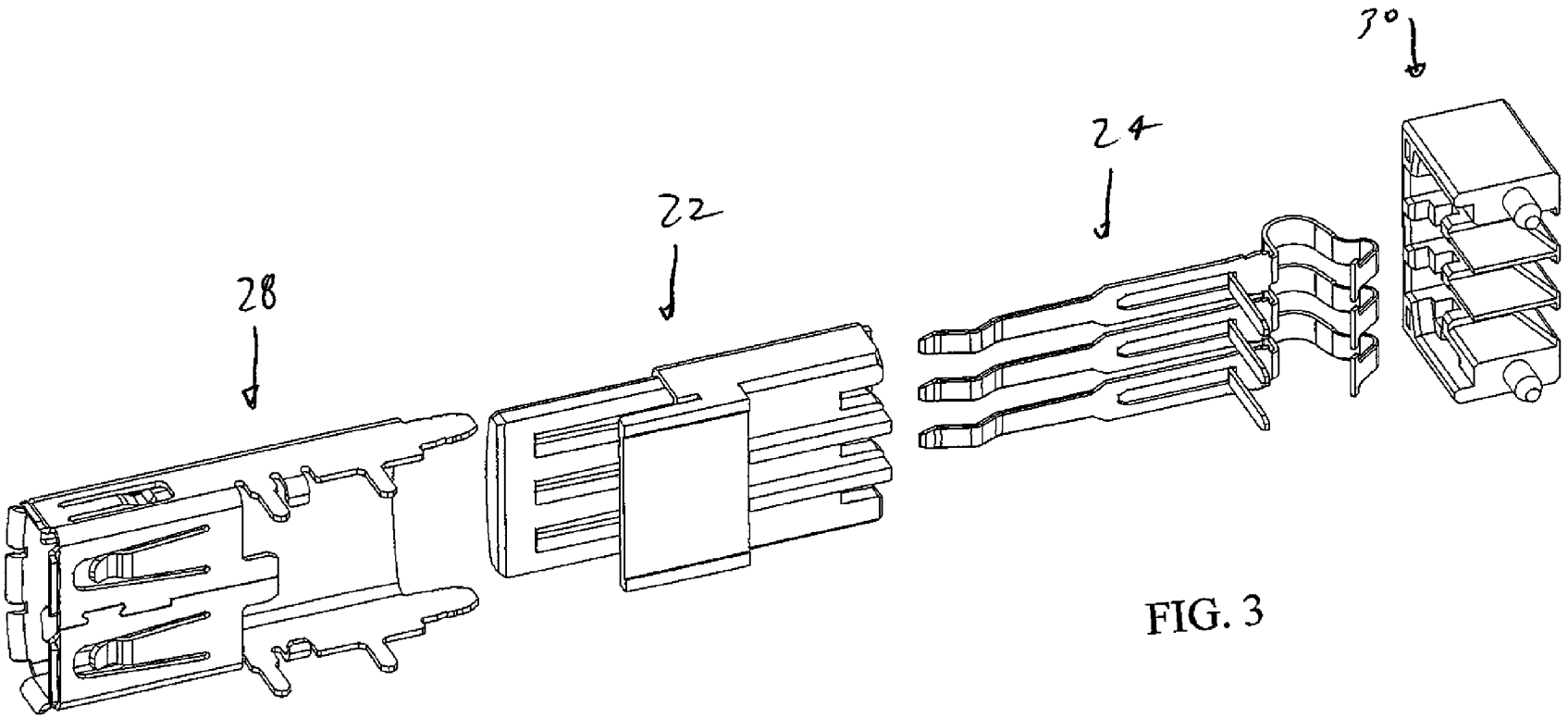
FIG. 3 is an exploded bottom perspective view of the components of the electrical connector of FIG. 1.
Figure 4:
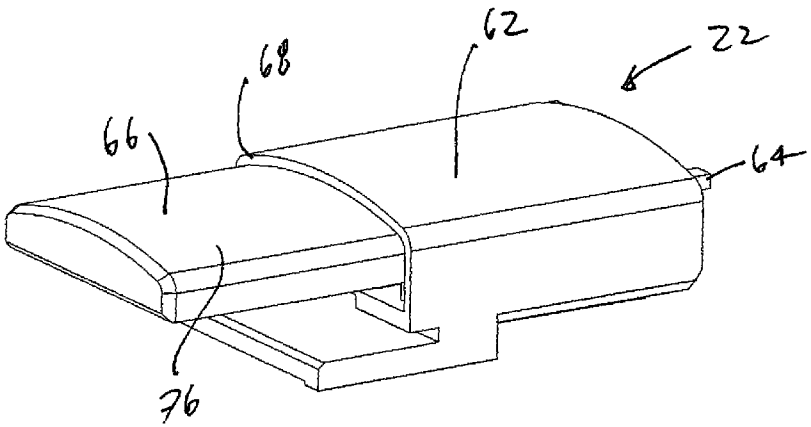
FIG. 4 is a top perspective view of a housing used in the electrical connector of FIG. 1.
Figure 5:
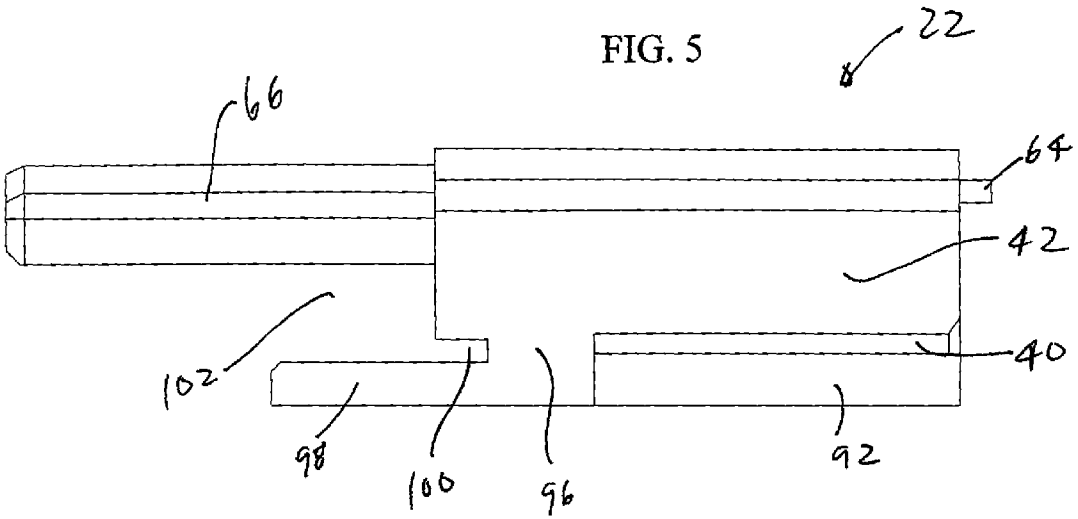
FIG. 5 is a side elevational view of the housing.
Figure 6:
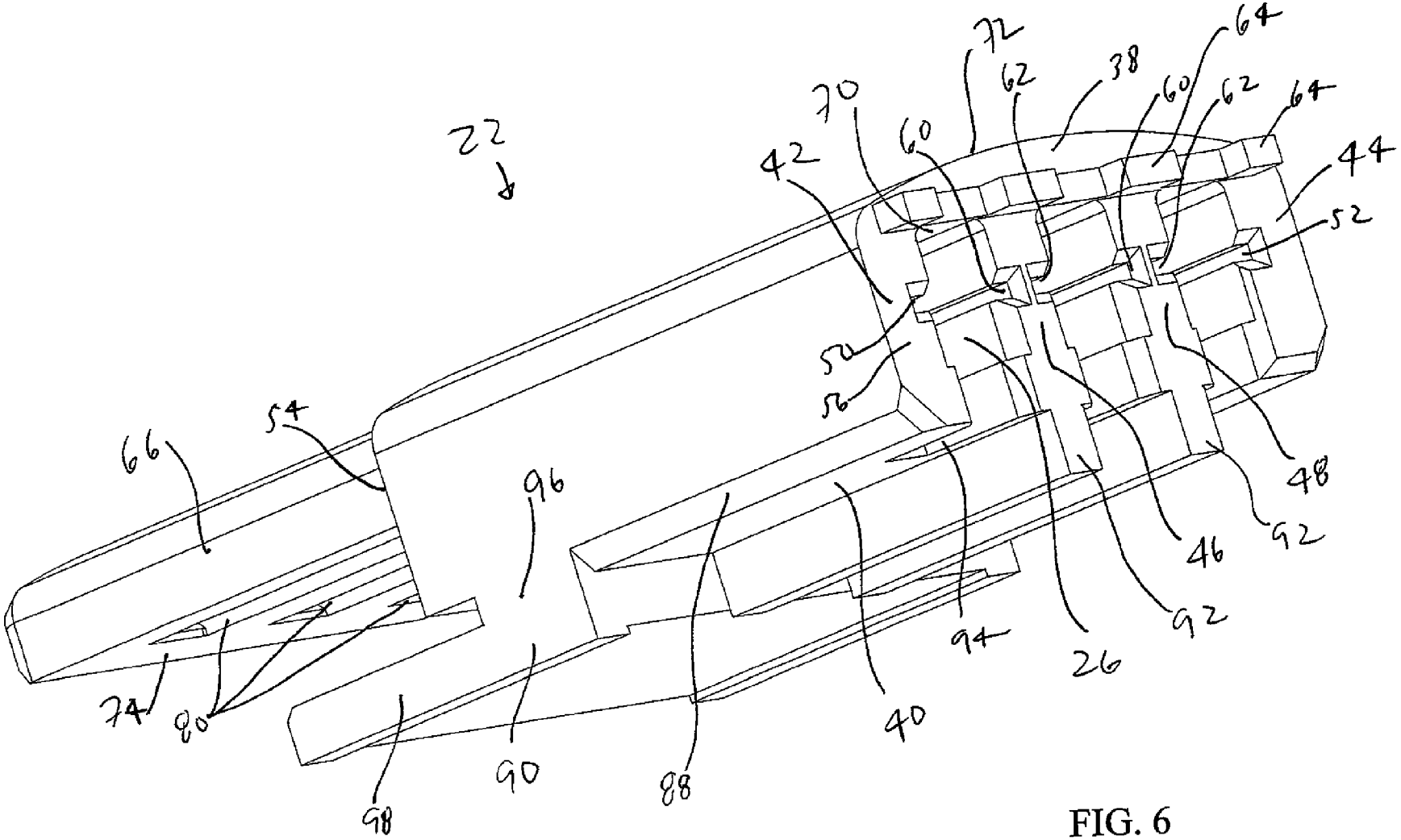
FIG. 6 is a front perspective view of the housing.
Figure 8:
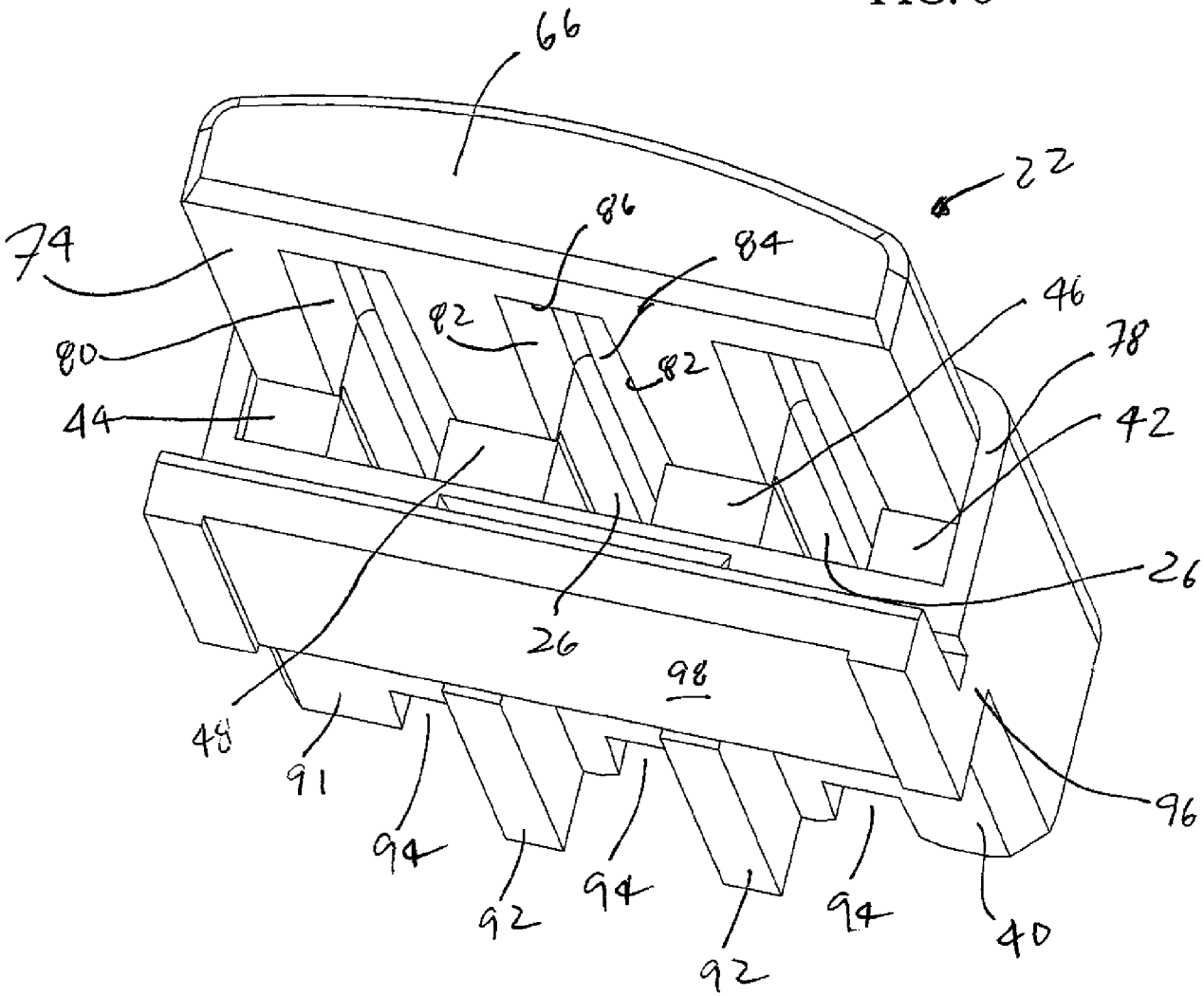
FIG. 8 is a bottom perspective view of the housing.

While the invention may be susceptible to embodiment in different forms, there is shown in the drawings, and herein will be described in detail, a specific embodiment with the understanding that the present disclosure is considered to be exemplary and is not intended to limit the invention to that as illustrated and described herein. Therefore, unless otherwise noted, features disclosed herein may be combined together to form additional combinations that were not otherwise shown for purposes of brevity. While the terms lower, upper and the like are used for ease in describing the depicted embodiments, it is to be understood that these terms do not denote a required orientation for use of the disclosed modules.

One benefit of the depicted design is that it allows for connector to be mounted on a circuit board and provide high current to a battery while avoiding the need for separate terminals to engage either the battery or the circuit board. Thus the cost of the connector can be kept low and the design can be compact while still providing greater performance and current handling than currently is available. Furthermore, because the terminals are configured to provide a direct path between an external source and a corresponding battery, the supporting circuit board does not need to be configure to handle such a large current and therefore can be made more cost effectively. In an embodiment, for example, the terminals can provide 6.0 A of continuous current from a cable directly to a battery.

As depicted, an electrical connector 20 includes a dielectric or insulative housing 22, a plurality of conductive terminals 24 housed within terminal receiving passageways 26 in the housing 22, a conductive shield 28 generally surrounding the housing 22, and a dielectric or insulative cover 30 which mates to the housing 22 and the shield 28. The electrical connector 20 connects a battery 32 to a printed circuit board (PCB) 34 of a portable electronic device (not shown) and to a cable 36. The electrical connector 20, the battery 32 and the cable 36 can be linearly aligned with each other. The electrical connector 20 can provide power to the PCB 34 from the battery 32 and the electrical connector 20 could also be used to charge the portable electronic device via the cable 36. The electrical connector 20 can also used to transmit power to the battery 32 from the cable 36, potentially at high current rates. This is useful because many batteries are configured to operate at a lower voltage (such as less than 24 volts) and therefore it is useful to have a higher current to charge the battery, assuming the battery can withstand high current charging.

As best shown in FIGS. 4-9, the housing 22 may be a one-piece structure unitarily molded of dielectric material or the like. The housing 22 includes an upper wall 38, a lower wall 40, a pair of side walls 42, 44 which connect the upper and lower walls 38, 40 together, and a pair of parallel upright walls 46, 48 which connect the upper and lower walls 38, 40 together.

The side and upright walls 42, 44, 46, 48 are spaced apart from each other and form the plurality of parallel spaced-apart terminal receiving passageways 26 through the housing 22. Each side wall 42, 44 is generally rectangular and has an elongated horizontal slot 50, 52 along its inner surface which extends from a rear end 54 of the side wall 42, 44 to the front end 56 of the side wall 42, 44. Each upright wall 46, 48 has an elongated horizontal slot 60, 62 therein on each side thereof which extends from a rear end of the upright wall 46, 48 to the front end of the upright wall 46, 48.

The upper wall 38 has a main body 62 which is connected to the side and upright walls 42, 44, 46, 48, a plurality of spaced-apart pegs 64 which extend from a front end of the main body 62, and a tongue 66 which extends from a rear end 68 of the main body 62 and from the rear ends of the side and upright walls 42, 44, 46, 48. The main body 62 has a flat lower surface 70 which is connected to the side and upright walls 42, 44, 46, 48, and a curved upper surface 72. The pegs 64 extend forwardly from the front end of the upper wall 38. The pegs 64 are aligned with the side and upright walls 42, 44, 46, 48.

The tongue 66 has a front end which is connected to the rear end of main body 62 and the side and upright walls 42, 44, 46, 48, a rear end opposite to the front end, and lower and upper surfaces 74, 76 extending between the front and rear ends. The upper surface 74 is curved to generally conform in shape to the curve of the upper surface 72 of the main body 62, but is offset from the curved upper surface 72 such that a shoulder 78 is formed at the rear end of the main body 62 around the curved upper surface 76 of the tongue 66. The lower surface 74 of the tongue 66 is vertically offset from the lower surface 70 of the main body 62. A plurality of spaced apart grooves 80 are provided in the lower surface 74 of the tongue 66. Each groove 80 has opposite side walls 82, an upper wall 84 and a rear wall 86. The rear wall 86 is spaced a predetermined distance from the rear end of the tongue 66. A slot 87 is provided in each rear wall 86 and extends rearwardly a predetermined distance from the rear wall 86. The side walls 80 are aligned with the respective side and upright walls 42, 44, 46, 48. The upper wall 84 of each groove 80 aligns with the lower surface 70 of the main body 62.

The lower wall 40 has a main body 88 which is connected to the side and upright walls 42, 44, 46, 48, a shelf 90 which extends from a lower surface 91 of the main body 88, and a pair of reinforcing ribs 92 which extend from the lower surface 91 of the main body 88. The main body 88 has a front end, a rear end, a flat upper surface which is connected to the side and upright walls 42, 44, 46, 48, and a flat lower surface. The front end of the main body 88 aligns with the front end of the main body 62 of the upper wall 38; the rear end of the main body 88 of the lower wall 40 aligns with the rear end of the main body 62 of the upper wall 38. A plurality of cutouts 94 are provided in the front end of the lower wall 40. The cutouts 94 align with the terminal receiving passageways 26.

The shelf 90 is generally L-shaped and has a vertical wall 96 and a horizontal wall 98. The vertical wall 96 extends downwardly from the lower surface 91 of the lower wall 40 at a position which is proximate to, but spaced from, the rear end of the lower wall 40. The horizontal wall 98 is perpendicular to and extends rearwardly a predetermined distance from the lower end of the vertical wall 96. The horizontal wall 98 does not extend rearwardly as far as the tongue 66 extends. As a result, a space 100 is formed between the vertical wall 96, the horizontal wall 98 and the lower wall 40, and a space 102 is formed between the horizontal wall 98 and the cable receiving extension 66.

A passageway 104 is formed through the lower wall 40 of the main body 62 and the vertical wall 96 of the shelf 90. The front and rear of each passageway 104 are open. A lower portion 105 of the passageway 104 which extends through the vertical wall 96 has a first section which extends forwardly from the rear end of the vertical wall 98 and a second section which extends forwardly from the first section to the front end of the vertical wall 98. The first section includes a pair of side walls extending from the rear end of the vertical wall and a front wall at the front ends of the side walls. Each side wall has a first tapered section 106 which extends forwardly and inwardly from the rear end of the vertical wall 96 and a second vertical section 108 which extends forwardly from the front end of the first tapered section 106. The second section is formed by a rectangular aperture 110 through the front end of the vertical wall 96. The second section has a dimension which is smaller than the first section.

The reinforcing ribs 92 extend from the lower surface 91 of the lower wall 40. The reinforcing ribs 92 start at the vertical wall 96 of the shelf 90 and extend forwardly to the front end of the lower wall 40. The reinforcing ribs 92 are spaced apart from each other and vertically align with the upright walls 46, 48.

Figure 10:
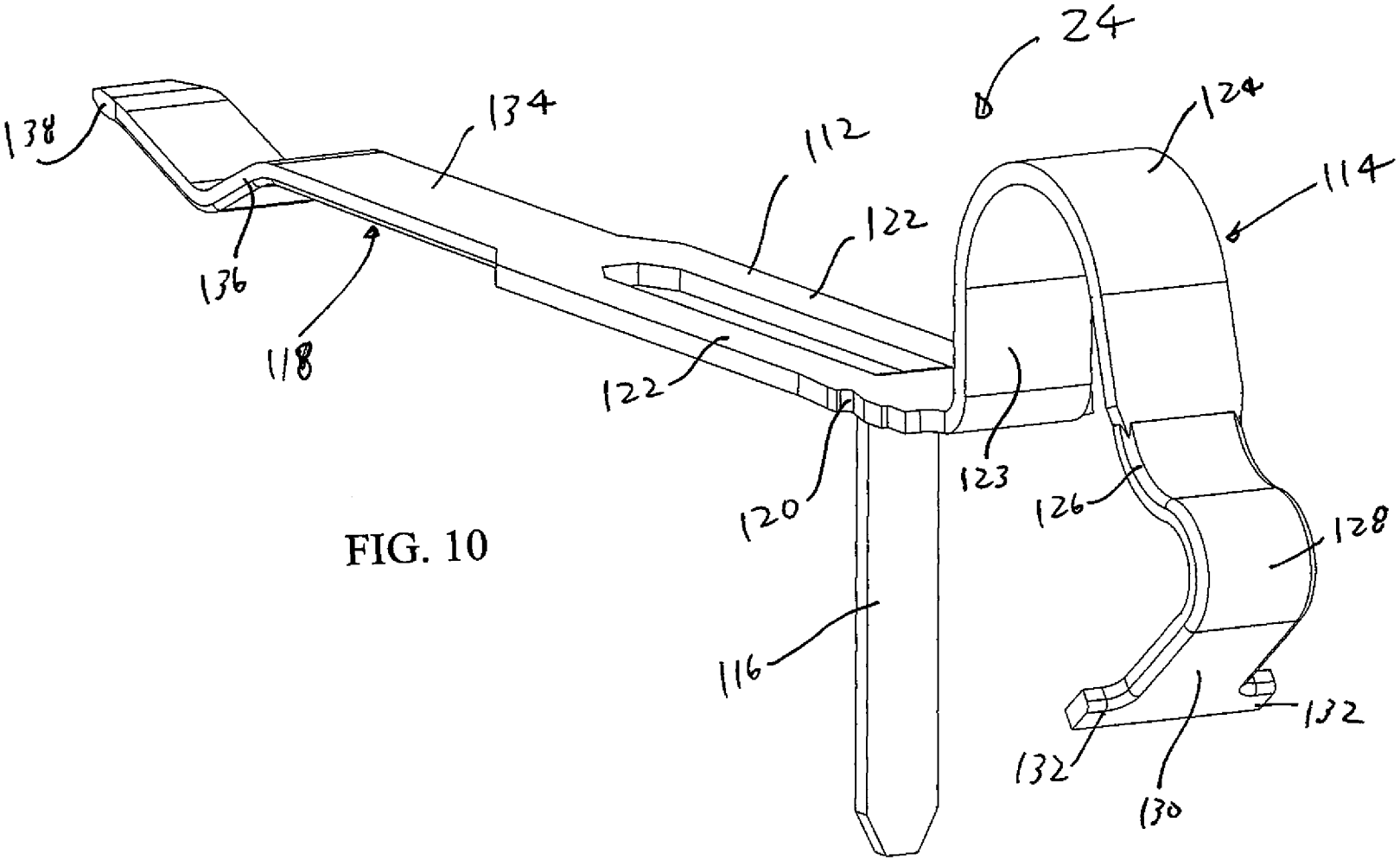
FIG. 10 is a front perspective view of a terminal used in the electrical connector of FIG. 1.
Figure 11:
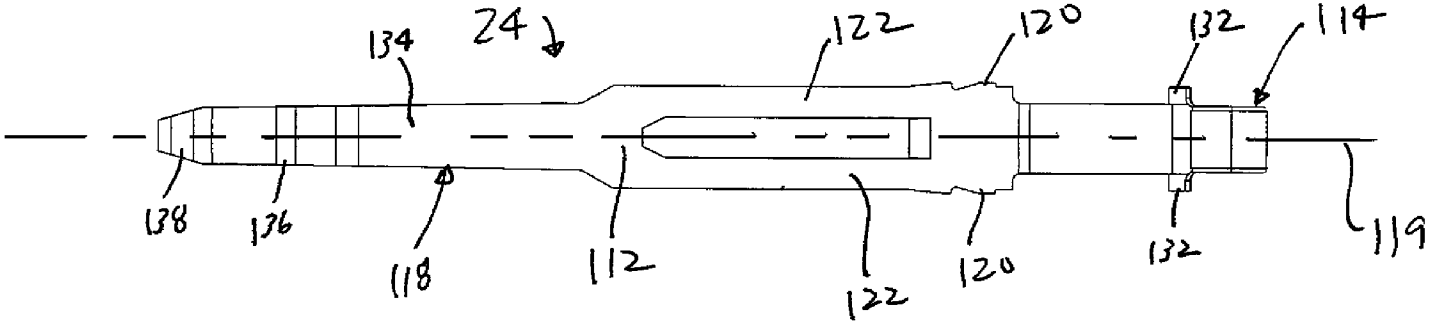
FIG. 11 is a top plan view of the terminal.
Figure 12:
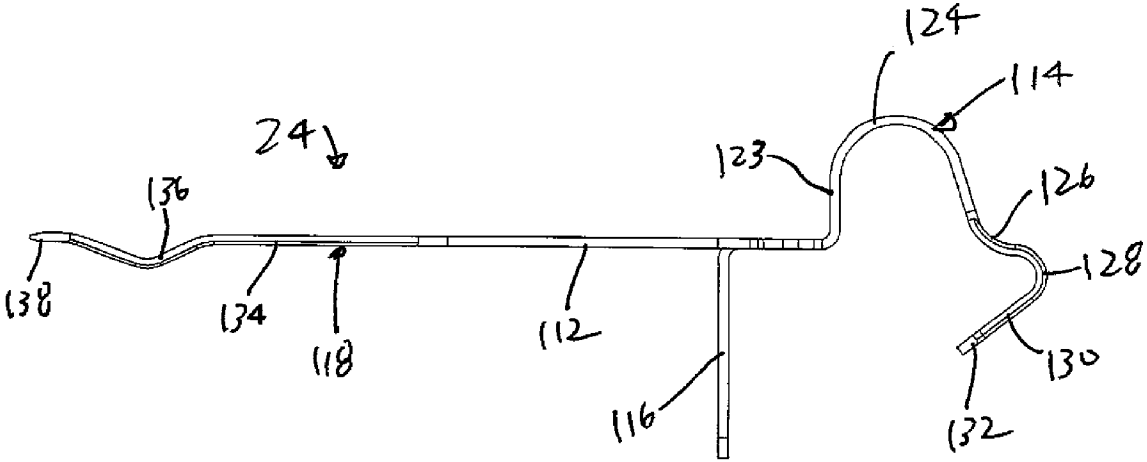
FIG. 12 is a side elevational of the terminal.

As shown in FIGS. 10-12, each conductive terminal 24 includes a main body portion 112, a front contact portion 114 for establishing electrical connection with contacts of the battery 32, a tail portion 116 for establishing electrical connection with traces on the PCB 34, and a rear contact portion 118 for establishing electrical connection with the associated cable 36, the rear contact portion 118 being supported by the tongue 66. The main body portion 112, the front contact portion 114, the tail portion 116 and the rear contact portion 118 are linearly aligned with each other such that a centerline 119 is defined along the length of the terminal 24. The terminals 24 can be stamped and formed of conductive sheet metal materials and are plated with appropriate materials as is known in the art.

The main body portion 112 is generally rectangular and planar. A securement wing 120 is provided on each side thereof proximate to the front end.

The tail portion 116 is struck from the main body portion 112 by suitable means such that portions 122 of the main body portion 112 are provided on either side of the tail portion 116. The tail portion 116 extends perpendicularly from the main body portion 112 and extends from the lower surface of the main body portion 112. As can be appreciated, the tail portion 116 can be configured for insertion into a via in a supporting circuit board.

The front contact portion 114 is generally U-shaped and includes a first upright portion 123 which extends perpendicularly to the main body portion 112, a second arcuate section 124 which extends upwardly and forwardly from the upper end of the first portion 123, a third arcuate section 126 which curves outwardly and forwardly from the second section 124, a fourth arcuate section 128 which curves outwardly and downwardly from the third section 126, and a fifth straight section 130 which extends from the end of the fourth section 128. A wing 132 extends from each side of the fifth section 130 at the free end thereof.

The rear contact portion 118 includes a first straight section 134 which has a front end connected to the rear end of the main body portion 112, a tang 136 which extends from the first section 134, and a third straight section 138 which extends from the end of the second section 136. The first and third sections 134, 138 are planar with the main body portion 112.

Figure 24:
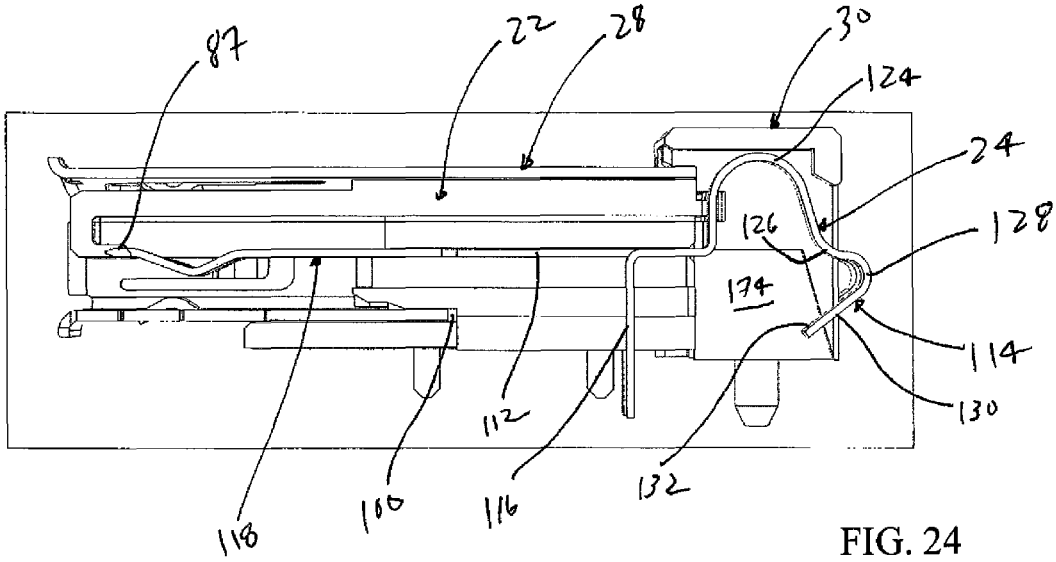
FIG. 24 is a cross-sectional view along line 24-24 of FIG. 22.

For each terminal 24, the main body portion 112 seats within the respective slots 50, 52, 60, 62 in the side and upright walls 42, 44, 46, 48 of the housing 22. The securement wings 120 bite into the walls of the slots 50, 52, 60, 62 and prevent the removal of the terminals 24 from the housing 22. The tail portions 116 of the terminals 24 seats within the respective cutouts 94 in the lower wall 40 and extend downwardly therefrom. The first upright section 123 of each front contact portion 114 is positioned between the respective pegs 64 such that the remainder of the front contact portion 114 extends forwardly of the housing. The rear contact portion 118 seats within the respective groove 80 of the tongue 66 and abuts against the top wall 84 of the respective groove 80. The third section 138 of each terminal 24 seats within the respective slot 87, see FIG. 24, to securely hold the rear end of each terminal 24.

Figure 13:
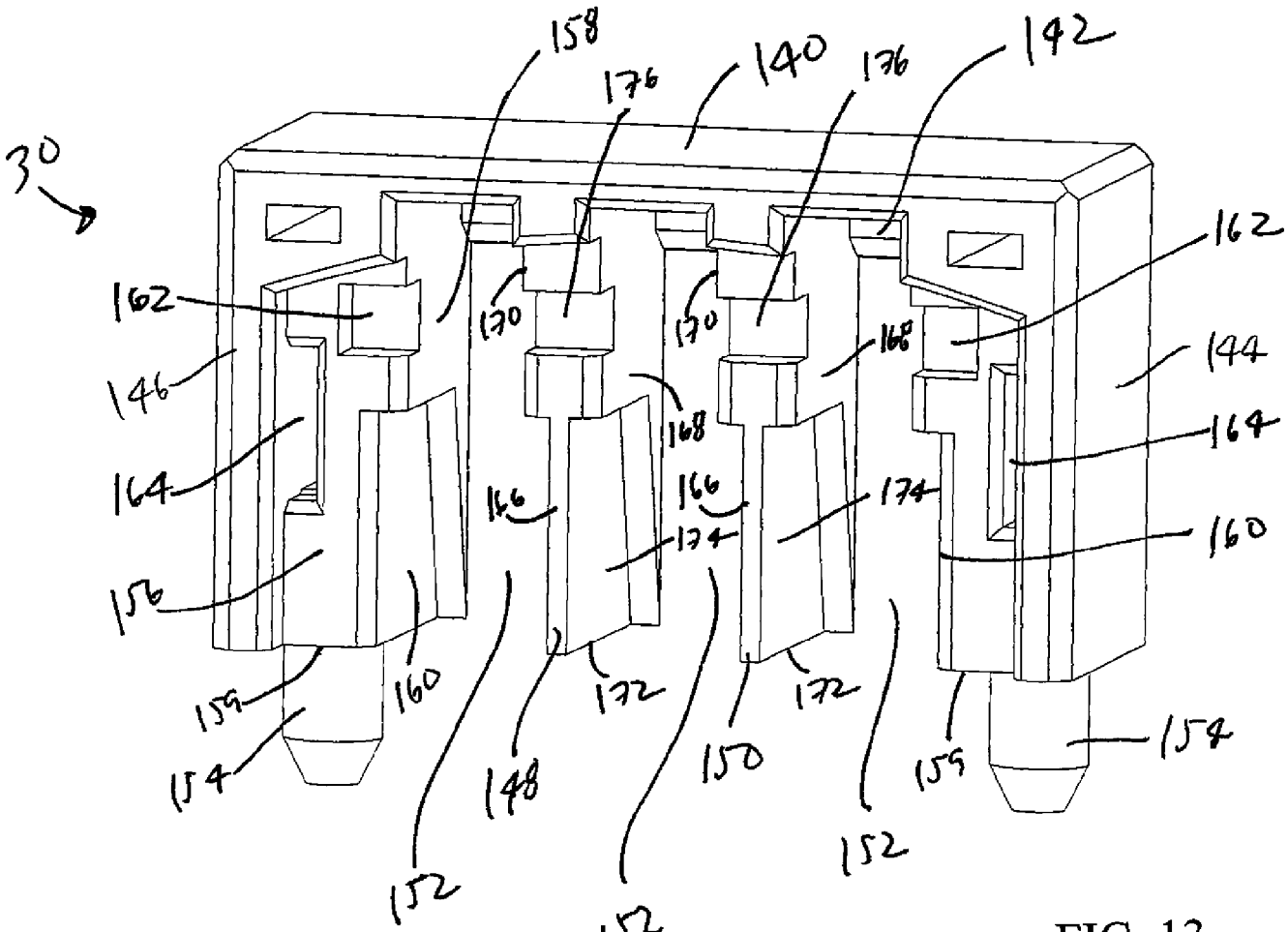
FIG. 13 is a rear perspective view of a cover used in the electrical connector of FIG. 1.
Figure 14:
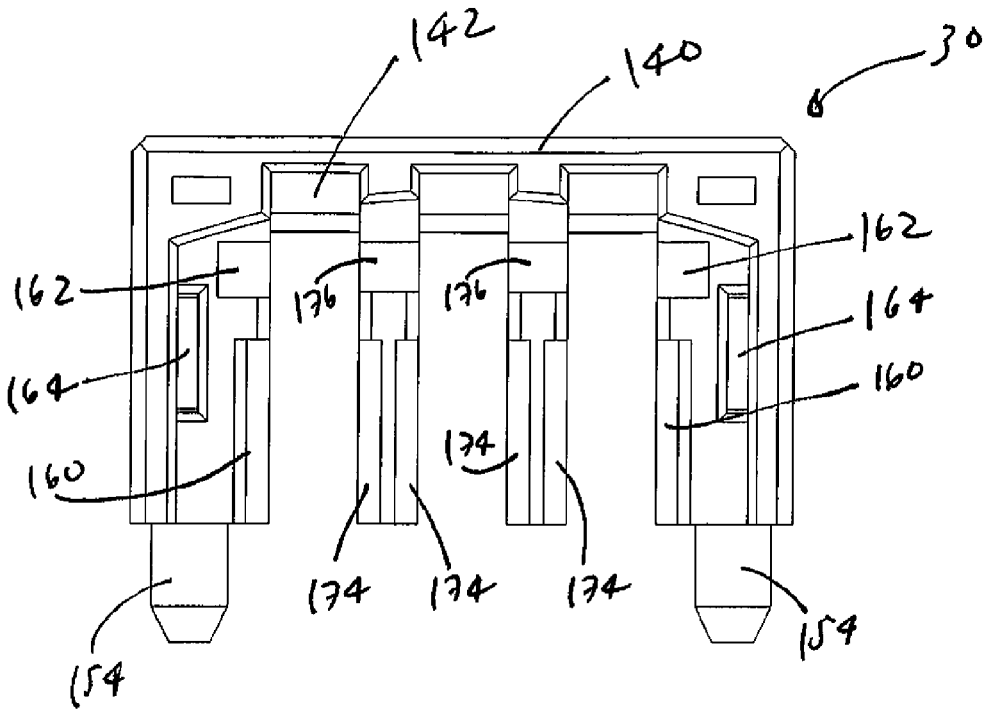
FIG. 14 is a rear plan view of the cover.
Figure 15:
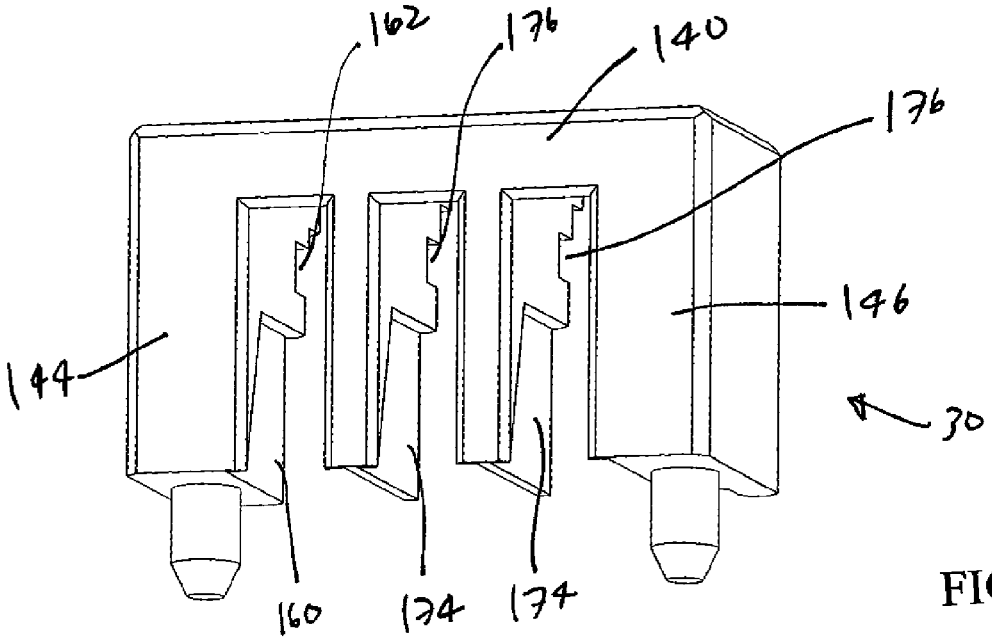
FIG. 15 is a front perspective view of the cover.
Figure 16:
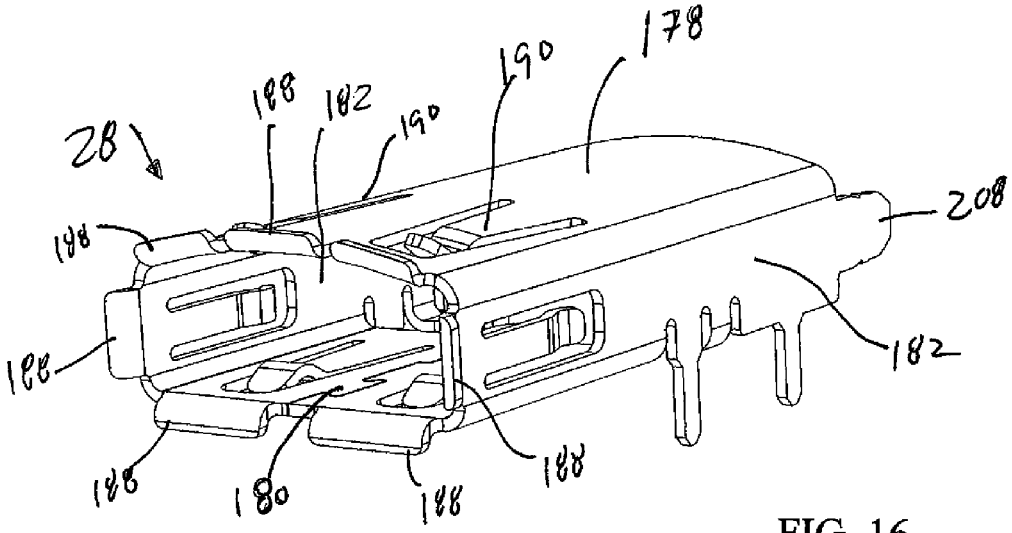
FIG. 16 is a rear perspective view of a shield used in the electrical connector of FIG. 1.
Figure 17:
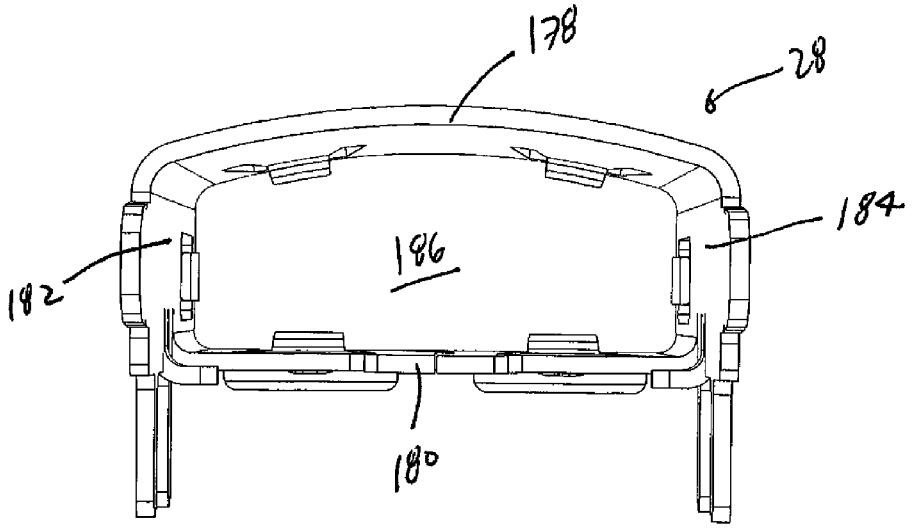
FIG. 17 is a rear plan view of the shield.
Figure 18:
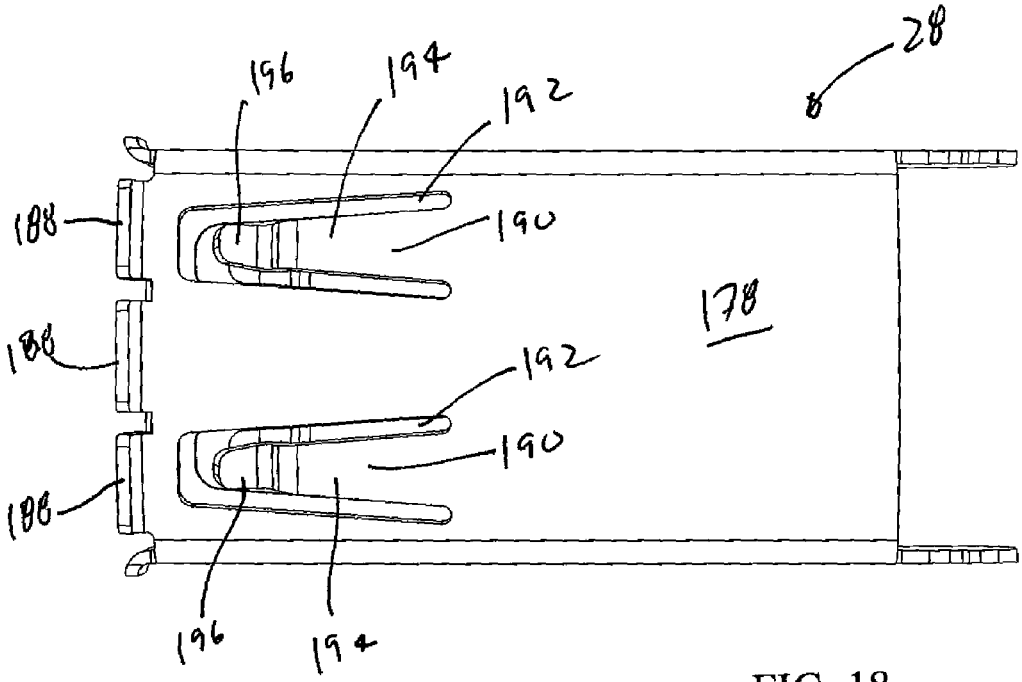
FIG. 18 is a top plan view of the shield.
Figure 19:
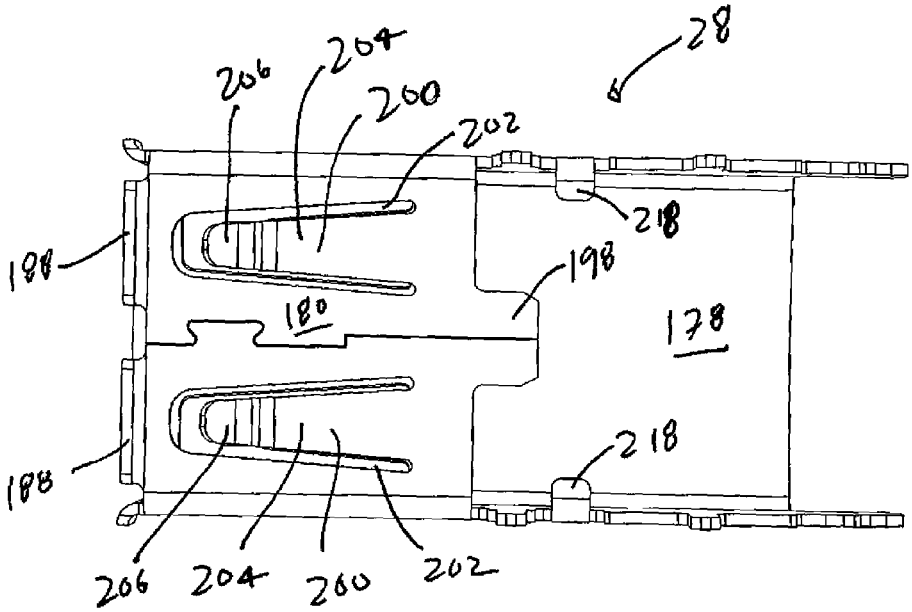
FIG. 19 is a bottom plan view of the shield.
Figure 20:
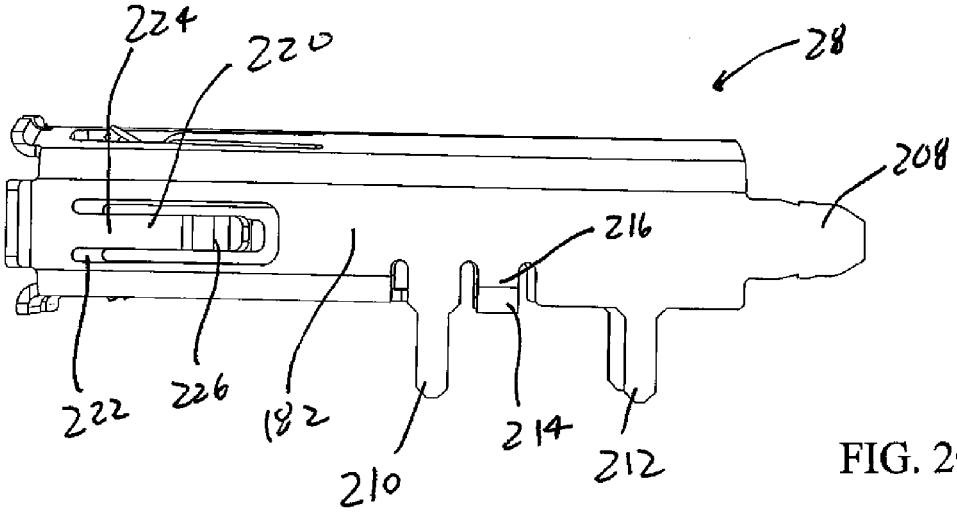
FIG. 20 is a side elevational view of the shield.
Figure 21:
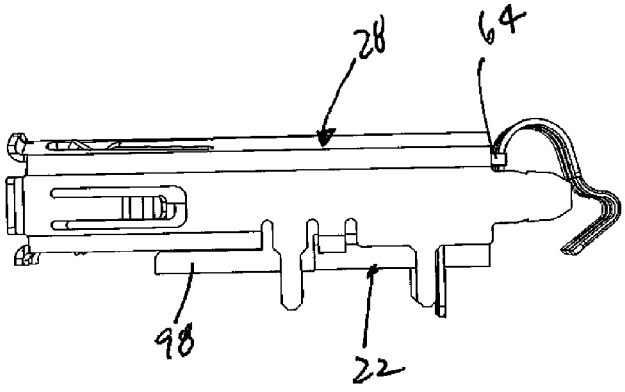
FIG. 21 is a side elevational view of the shield, the housing and the terminal connected together.
Figure 22:
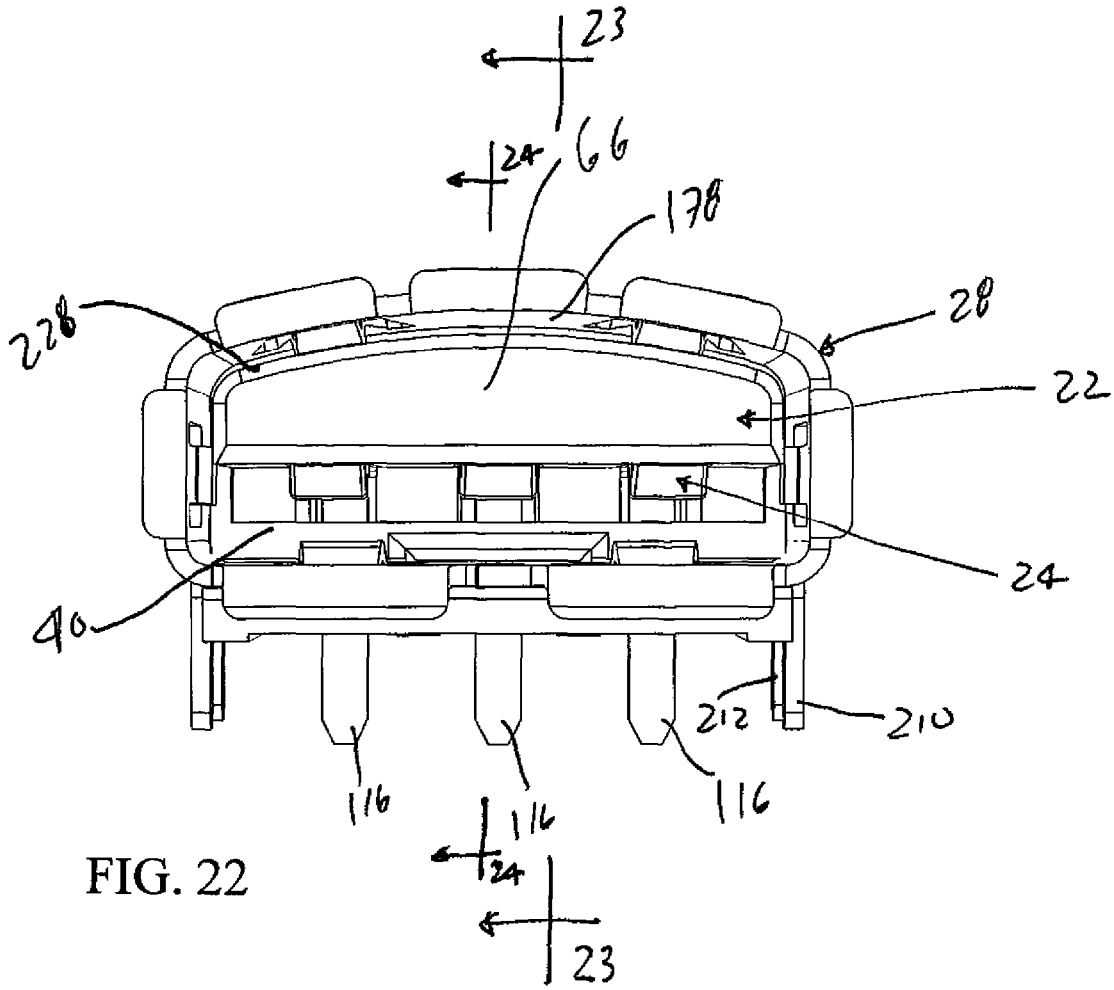
FIG. 22 is a rear elevational view of the shield, the housing and the terminal connected together.
Figure 23:
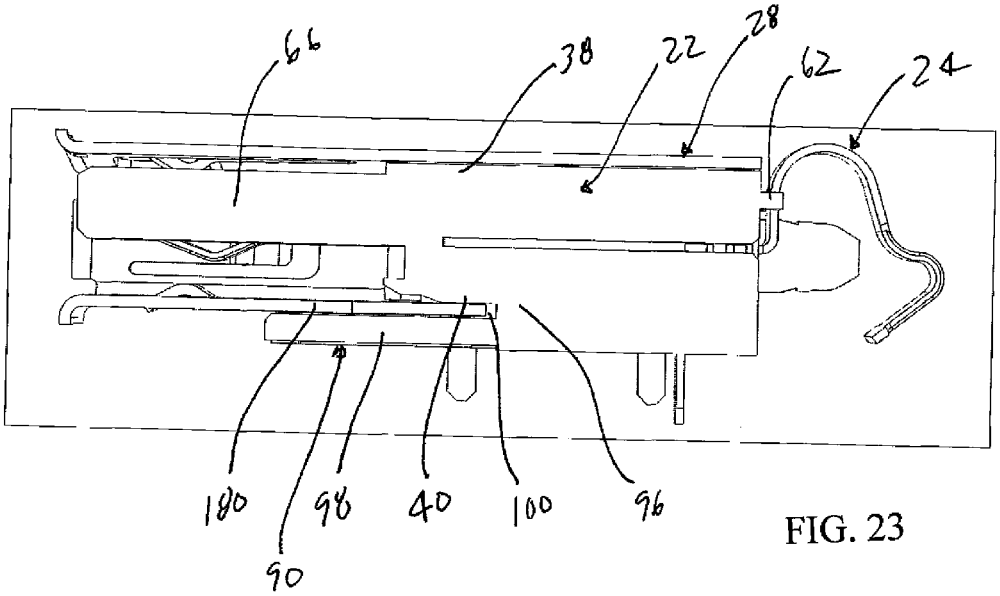
FIG. 23 is a cross-sectional view along line 23-23 of FIG. 22.

The cover 30, FIGS. 13-15, has an upper wall 140, a front wall 142 extending downwardly therefrom along a front end of the upper wall 140, a side wall 144, 146 extending downwardly from each side edge of the upper wall 140, and a pair of spaced apart upright walls 148, 150 depending downwardly therefrom. The side and upright walls 144, 146, 148, 150 are spaced apart from each other to define a plurality of terminal receiving spaces 152. A mounting peg 154 extends from the lower end of each side wall 144, 146.

Each side wall 144, 146 is generally rectangular and has a front surface, a rear surface 156, an outer surface, an inner surface 158 and a bottom surface 159. Each side wall 144, 146 has an elongated cutout 160 on its inner surface 158 which extends from the bottom surface 159 upwardly a predetermined distance and from the rear surface 156 forwardly a predetermined distance. Each side wall 144, 146 further includes a recess 162 on its rear surface 156 which is positioned between the cutout 160 and the upper wall 140. Each recess 162 conforms in shape to the pegs 64 on the housing 22 and extends from the inner surface 158 outwardly a predetermined distance. An elongated slot 164 is formed in each side wall 144, 146. Each slot 164 starts at the rear surface 156 and extends a forwardly predetermined distance. Each slot 164 is provided between the outer surface of the respective side wall and the cutout 160/recess 162.

Each upright wall 148, 150 is generally rectangular and has a front surface, a rear surface 166, opposite side surfaces 168, 170 and a bottom surface 172. On each side surface 168, 170, each upright wall 148, 150 has an elongated cutout 174 which extends from the bottom surface 172 upwardly a predetermined distance and from the rear surface 166 forwardly a predetermined distance. Each upright wall 148, 150 further includes a recess 176 on its rear surface 166 which is positioned between the cutouts 174 and the upper wall 140. Each recess 176 conforms in shape to the pegs 64 on the housing 22 and extends between the side surfaces 168, 170.

As best shown in FIGS. 16-20, the shield 28 is formed from an upper wall 178, a lower wall 180 and a pair of side walls 182 joining the upper and lower walls 178, 180 together. A through passageway 186 is defined by the walls 178, 180, 182 into which the cable 36 and the housing 22 are inserted. A rear end of each walls 178, 180, 182 includes one or more curved sections 188 for promoting insertion of the cable 36 into the shield 28.

The upper wall 178 is curved and has a pair of deflectable locking arms 190 formed therein. Each locking arm 190 is separated on three sides from the remainder of the upper wall 178 by an aperture 192. Each locking arm 190 includes a body 194 which is attached and conforms in shape to the remainder of the upper wall 178, and a curved tang 196 at its free end which extends into the passageway 186. Each tang 196 is proximate to, but spaced from, the rear end of the upper wall 178. The locking arms 190 can deflect outwardly relative to the remainder of the upper wall 178.

The lower wall 180 is generally rectangular and planar. The lower wall 180 has a length which is less than the length of the upper wall 178. A projection 198 extends forwardly from a front end of the lower wall 180. The projection 198 conforms in shape to the lower portion 105 of the passageway 104 in the shelf 90. A pair of deflectable locking arms 200 are formed in the lower wall 180. Each locking arm 200 is separated on three sides from the remainder of the lower wall 180 by an aperture 202. Each locking arm 200 includes a body 204 which is attached and conforms in shape to the remainder of the lower wall 180, and a curved tang 206 at its free end which extends into the passageway 186. Each tang 206 is proximate to, but spaced from, the rear end of the lower wall 180. The locking arms 200 can deflect outwardly relative to the remainder of the lower wall 180.

Each side wall 182 is generally rectangular and planar. A finger 208 extends forwardly from a front end of each side wall 182 and conforms in shape to the slot 164 in the respective side wall 144, 146 of the cover 30. First and second spaced apart mounting feet 210, 212 extend vertically downwardly from the lower end of each side wall 182 for mounting to the PCB 34. The first mounting foot 210 is provided proximate to the front end of the lower wall 180. The second mounting foot 212 is provided proximate to the front end of the respective side wall 182. A retaining arm 214 extends downwardly and inwardly from each side wall 182 and is positioned between the first and second mounting feet 210, 212. Each retaining arm 214 is generally L-shaped and includes a vertical portion 216 extending downwardly from the side wall 182 and a horizontal portion 218 which perpendicular to the vertical portion 216 and extends inwardly. A deflectable locking arm 220 is formed in each side wall 182. Each locking arm 220 is separated on three sides from the remainder of the respective side wall 182 by an aperture 222. Each locking arm 220 includes a body 224 which is attached and conforms in shape to the remainder of the respective side wall 182, and a curved tang 226 at its free end which extends into the passageway 186. The body 224 is attached to the remainder of the respective side wall 182 proximate to the rear end thereof; each tang 226 is spaced from the rear end thereof. The locking arms 220 can deflect outwardly relative to the remainder of the respective side wall 182.

As shown in FIGS. 21-24, the housing 28 with the terminals 24 mounted therein seats within the shield 28. The curved upper wall 38 of the housing 22 seats against the curved upper wall 178 of the shield 28 and the pegs 64 extend forwardly of the front end of the upper and side walls 178, 182 of the shield 28 so that the pegs 64 can be inserted into the associated recesses 162, 176 in the cover 30. The front end of the lower wall 180 of the shield 28 seats within the space 100 between the lower wall 40 of the housing 22 and the horizontal wall 98 of the shelf 90. The lower wall 180 of the shield 28 partially seats on the upper surface of the horizontal wall 98 of the shelf 90. The shelf 90 acts as a support for the shield 28. The tongue 198 on the lower wall 180 of the shield 28 seats within the lower portion 105 of the passageway 104 which extends through the vertical wall 96. The retaining arms 214 engage the lower wall 40 of the housing 22 to secure the housing 22 to the shield 28.

The tongue 66 seats within the passageway 186. The curved upper surface 76 of the tongue 66 is spaced from the upper and side walls 178, 182, 184 of the shield 28, and the lower surface 74 of the tongue 66 is spaced from the lower wall 180 of the shield 28. This defines a cable insertion space 228 between the shield 28 and the tongue 66. It should be noted that the curved shape of the upper surface 76 provides a beneficial aesthetic appearance. While the use of the curved shape can provide certain functional benefits, the desired profile of the curve could be modified as desired.

A cable housing 230 on the cable 36 is mounted within and fills the space 228. The upper wall 231 of the cable housing 230 is curved to mirror the shape of the curved upper wall 178 of the shield 28. The curved upper wall 178 of the shield 28 provides a visual means for the user to aid the user in orienting the cable housing 230 in the proper direction. During insertion, the locking arms 190, 200, 220 on the shield 28 deflect outwardly as the cable housing 230 is inserted into the space 228, but the locking arms 190, 200, 220 resume their natural position when the tangs 196, 206, 226 enter into associate apertures (not shown) in the cable housing 230 to secure the cable housing 230 and the shield 28 together. The locking arms 190, 200, 220 provide an estimated 7-10 pounds of cable housing 230 to connector 20 retention. This feature can be adjusted for less deflection or retention if more clearance between the cable housing 230 and connector 20 is required. When inserted, contacts 232 provided in the cable housing 230 mate with the tangs 136 of the rear contact portion 118 of the terminals 24. The tangs 136 can deform to provide the mating engagement. The slots 87 provide sufficient clearance for the rear contact portion 118 to elongate when the tangs 136 deform.

The housing 22 and the cover 30 are joined together by positioning the front surface of housing 22 against the rear surfaces of the side and upright walls 144, 146, 148, 150. The pegs 64 on the housing 22 insert into the recesses 162, 176 in the cover 30. The front contact portion 114 of each terminal 24 seats within the respective terminal receiving space 152 in the cover 30. The fourth section 128 of each terminal 24 extends forwardly of the front surfaces of the side and upright walls 144, 146, 148, 150. The wings 132 on the fifth portion 130 of each terminal 24 seat within the cutouts 160, 174 of the respective side and upright walls 144, 146, 148, 150, thereby preventing the front contact portions 114 of the terminals 24 from disengaging from the cover 30. The outer end of each wing 132 engages the respective side and upright walls 144, 146, 148, 150. The cover 30 and the housing 22 are suitable joined together, such as by adhesive, ultrasonic welding or the like.

The battery 32 has contacts 234 which engage with the fourth section 128 of the terminals 24 to electrically connect the battery 32 to the electrical connector 20. The battery 32 abuts against the front surface of the cover 30 which causes the second section 124 and/or third section 126 and/or fourth section 128 to deflect within the cover 30. Since the wings 132 on the fifth portion 130 of each terminal 24 engages the respective side and upright walls 144, 146, 148, 150 of the cutouts 160, 174, the terminals 24 primarily deflect along the plane of the centerline 119 of the terminal 24.

Figure 25:
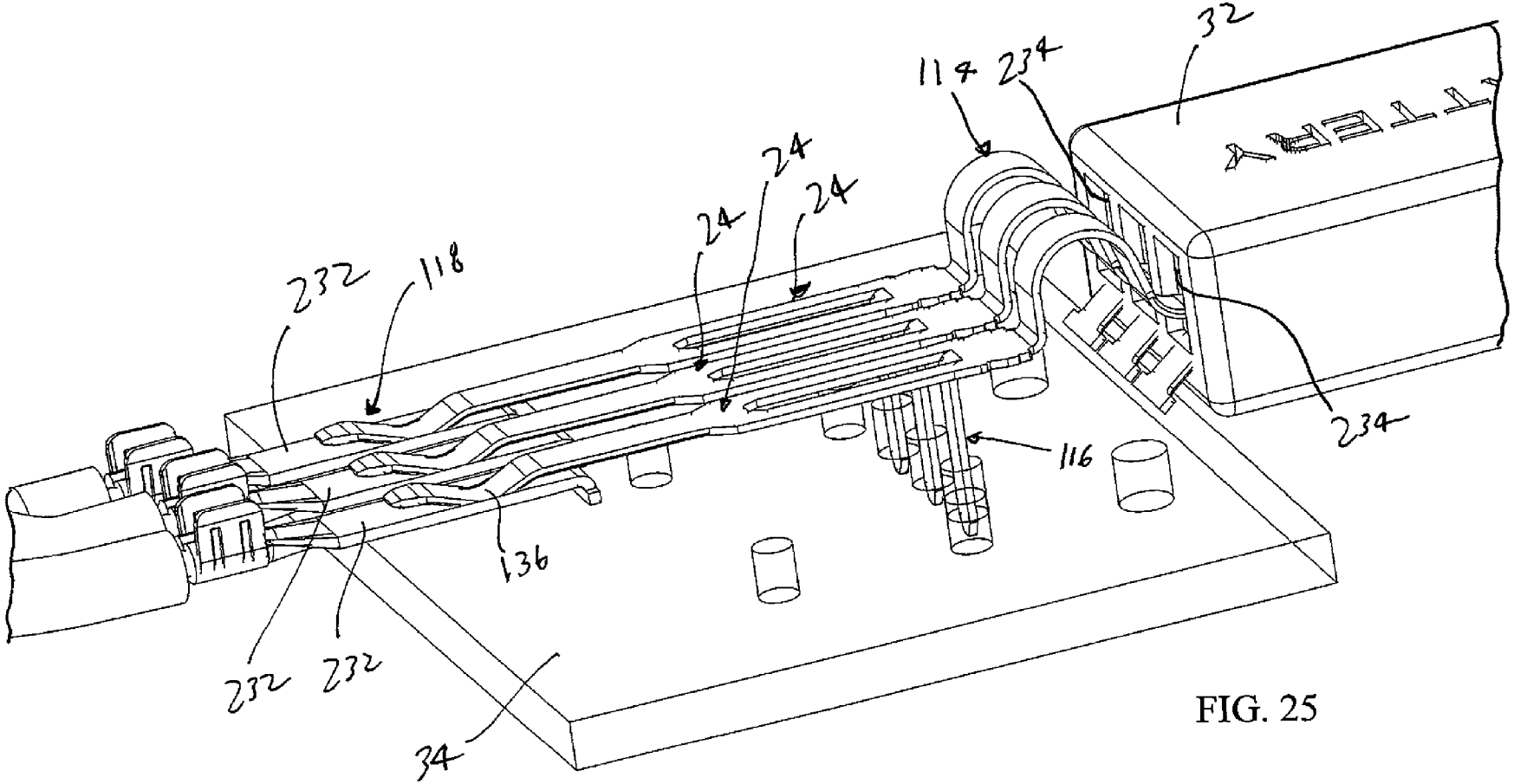
FIG. 25 is a perspective view of the terminals of the electrical connector connected to the battery, to the printed circuit board and to the cable of an electronic device.

The front contact portion 114 of each terminal 24 defines a pitch at the battery side of 3.0 mm. The rear contact portion 118 of each terminal 24 defines a pitch at the cable side of 3.0 mm. The tales are also positioned at a pitch of about 3.0 mm. Thus, the depicted embodiment provides sufficient space between the terminals so as to allow for desirable electrical separation and/or thermal dissipation. As shown in FIG. 25, the electrical connector 30 provides a smooth transition between the terminals in the battery 32 and the terminals in the cable 36. As shown, the height of the fourth section 128 matches the location of the contacts 234 on the battery 32 and thus, the top end of the battery 32 is flush with the upper surface of the housing 28.

The mounting pegs 154 of the cover 30 mount within suitable holes in the PCB 34 and are secured thereto by suitable means. The mounting feet 210, 212 of the shield 28 seat within holes in the PCB 34 and can be soldered to the PCB 34 to ground the shield 28 to the PCB 34. The tail portions 116 of the terminals 24 are mounted within suitable holes in the PCB 34 and are secured thereto by suitable means, such as by press-fit or soldering. As can be appreciated, this allows the terminals 24 of the connector to be more securely coupled to the supporting circuit board and helps them to retain electrical connection with the circuit board even after repeated stressing of the terminals 24 (such as might be caused by insertion of a cable connector).

While the depicted embodiments have been shown and described, it is envisioned that those skilled in the art may devise various modifications without departing from the spirit and scope of the appended claims.

The invention claimed is:

1. An electrical connector comprising:

a shield;

an insulative housing position in the shield and having a front end and a rear end opposite to the front end and a plurality of terminal receiving passageway extending between the front end and the rear end, the housing including a tongue extending towards the rear; and a plurality of conductive terminals, each terminal mounted in the terminal receiving passageway, the terminals having a main body defining a centerline, a front contact portion extending from a front end of the main body and capable of engagement with contacts of a battery, the terminals further including a rear contact portion extending from a rear end of the main body and supported by the tongue, and a tail portion extending from the main body and positioned between the front contact portion and the rear contact portion, the tail portion configured to be inserted in a printed circuit board, the front contact portion capable of deflecting along a plane defined by the centerline.

2. The electrical connector of claim 1, wherein the front contact portion configured to be deflected in a first direction and the rear contact portion is configured to engage a mating contact inserted in a second direction, the second direction being the opposite of the first direction.

3. The electrical connector of claim 1, wherein the shield includes an upper wall with a curved surface.

4. The electrical connector of claim 1, wherein the rear contact portion includes an arcuate portion that extends away from the tongue.

5. The electrical connector of claim 1, wherein the tail portion extends substantially perpendicularly to the main body.

6. The electrical connector of claim 5, wherein the tail portion is formed from the main body such that an aperture is created in the main body of the forming of the tail portion.

7. The electrical connector of claim 1, wherein the housing comprises an upper wall, a lower wall, a pair of side walls and at least one intermediate wall connecting the upper and lower walls together, the walls defining the terminal receiving passageways, the upper wall of the housing being curved.

8. The electrical connector of claim 1, further comprising an insulative cover that is positioned on the front end of the housing, the cover having an upper wall that extends over the front contact portion of the plurality of terminals.

9. The electrical connector of claim 8, wherein the housing includes a shelf extending from the lower wall, the shelf defining a receiving space between the shelf and the tongue, wherein the upper wall of the shield extends from a rear edge of the tongue to the cover and the shield further includes a lower wall position between the shelf and the tongue and a pair of side walls generally covering the side walls of the housing.

10. The electrical connector of claim 9, wherein the housing includes a slot positioned between the shelf and the tongue and the lower wall of the shield includes a projection which is inserted into the slot.

11. The electrical connector of claim 10, wherein the cover is attached to the housing and to the shield and has a front end and a rear end opposite to the front end and a terminal receiving passageway extending between the front and rear ends of the cover, the front contact portion of the terminal being seated within the terminal receiving passageway of the cover.

12. The electrical connector of claim 11, wherein the cover includes a pair of slots and the shield includes a pair of finger which are inserted into the slots.

13. An electrical connector comprising:

an insulative housing including an upper wall, a lower wall, a pair of side walls, at least one intermediate wall connecting the upper and lower walls together, the walls defining terminal receiving passageways, and a shelf extending from the lower wall, the shelf defining a receiving space between a portion of the shelf and the lower wall;

a conductive terminal mounted in the terminal receiving passageway, the terminal having a main body defining a centerline, a front contact portion extending from a front end of the main body, a rear contact portion extending from a rear end of the main body, and a tail portion extending from the main body, the tail portion formed from the body portion such that an aperture is provided in the main body;

a conductive shield including an upper wall generally covering the upper wall of the housing, a lower wall generally covering the lower wall of the housing, a pair of side walls generally covering the side walls of the housing, the lower wall of the shield being seated within the receiving space of the housing such that the lower wall of the shield is supported by the shelf, the housing providing insulation between the conductive terminal and the shield.

14. The electrical connector of claim 13, wherein the tail portion extending perpendicularly to the main body and is located between the front and rear contact portions.

15. The electrical connector of claim 13, wherein the upper wall of the housing is curved.

16. The electrical connector of claim 13, wherein the shelf includes a slot, and the shield includes a tongue which is inserted into the slot.

17. The electrical connector of claim 16, wherein the cover includes a pair of slots, and the shield includes a pair of tongues which are inserted into the slots.

18. The electrical connector of claim 13, further including an insulative cover attached to the housing and to the shield, the cover being separate from the housing, the cover having a front end and a rear end opposite to the front end and a terminal receiving passageway extending between the front and rear ends of the cover, the front contact portion of the terminal being seated within the terminal receiving passageway of the cover.

* * * * *